US005419735A

United States Patent [19]

Imahashi et al.

[11] Patent Number: 5,419,735

[45] Date of Patent: May 30, 1995

[54] MAGNETIC BARREL FINISHING MACHINE

[75] Inventors: Takahiro Imahashi, Kokubunji; Kazuhiro Kunugi, Kofu, both of Japan

[73] Assignee: Imahashi Mfg. Co., Ltd., Tokyo, Japan

[21] Appl. No.: 230,234

[22] Filed: Apr. 20, 1994

[30] Foreign Application Priority Data

Jun. 24, 1993 [JP] Japan ..... 5-153746

[51] Int. Cl.[6] ..... B24B 31/00

[52] U.S. Cl. ..... 451/113; 451/104; 451/327; 451/35; 451/36

[58] Field of Search ..... 51/6, 7, 16, 17, 316, 51/317, 163.1, 163.2, 164.1, 164.5

[56] References Cited

U.S. PATENT DOCUMENTS

| | | | |
|---|---|---|---|
| 4,175,930 | 11/1979 | Sakulevich et al. | 51/317 |
| 4,211,041 | 7/1980 | Sakulevich et al. | 51/7 |
| 4,599,826 | 7/1986 | Podoprigoro | 51/72 R |
| 5,044,128 | 9/1991 | Nakano | 51/17 |

FOREIGN PATENT DOCUMENTS

| | | | |
|---|---|---|---|
| 1371881 | 2/1988 | U.S.S.R. | 51/7 |

*Primary Examiner*—Bruce M. Kisliuk
*Assistant Examiner*—Eileen P. Morgan
*Attorney, Agent, or Firm*—Wenderoth, Lind & Ponack

[57] ABSTRACT

A magnetic barrel finishing machine includes multiple different flows or motions of an abrasive medium and workpieces by varying magnetic fields, freeing the workpieces from the abrasive medium and subjecting the workpieces to a finishing action with the abrasive medium. The machine includes a rotary disk made of nonferromagnetic material, a plurality of permanent magnets rigidly mounted on the rotary disk, and a container located above the rotary disk with a small gap therebetween for containing the abrasive medium and the workpieces being finished thereby. The permanent magnets are arranged irregularly such that they provide magnetic lines of force acting in a circumferential direction as well as in a radial direction of the rotary disk.

6 Claims, 6 Drawing Sheets

MAGNETIC BARREL FINISHING MACHINE

BACKGROUND OF THE INVENTION

1. Field of the Invention

In general, the present invention relates to a barrel finishing machine. More particularly, the present invention relates to such a machine that includes means for producing a rotating magnetic field and for varying the rotating magnetic field in such a way that multiple different flows or motions are produced in a mixture of workpieces and an abrasive medium, thereby freeing the workpieces from the abrasive medium and subjecting the workpieces to a finishing action by the abrasive medium.

2. Description of the Prior Art

A metal finishing machine is described in two Japanese patent applications. One is published for opposition under the examined publication No. 4-26981 and the other is laid open to public inspection under the unexamined publication No. 60-118466. In both of the applications, the machine is designed to produce a magnetic field and vary the magnetic field by rotation in such a manner that flows or motions of workpieces and an abrasive medium are produced in multiple different ways within a container, thereby freeing the workpieces from the abrasive medium and subjecting the workpieces to a finishing action by the abrasive medium.

The conventional machine has the following disadvantages and problems. If the container that contains the workpieces and the abrasive medium is placed in the center on a rotary disk on which permanent magnets are mounted, the workpieces will tend to be finished unevenly. Thus, extra time must be required until the finishing process is completed. The magnets that produce the magnetic fields are arranged regularly. That is every adjacent magnet has its respective polarity alternating like NS, NS, and so on. This regular arrangement of polarities may produce flows or motions of the works and abrasive media that occur repeatedly but regularly. Sometimes, this presents a defect that causes the irregular finishing action against the works or a requirement of extra time for the finishing operation for completion.

For example, the regular arrangement of polarities such as N, S, N, S, and so on, as described above, produces circumferential or concentric flows or motions of the abrasive medium as shown by arrows 21 in FIG. 7, which are formed into loops 22 in FIG. 8.

It may readily be understood that a container 23 that contains workpieces and abrasive medium (which includes ferromagnetic substances, abrasive media, compounds, and the like) must be placed within the region 24 influenced by the magnetic action (FIG. 9). As the region 24 is formed like a doughnut, it is clear that the container 23 must have a diameter that is equal to half the diameter of the rotary disk 25 or smaller.

Assuming, for example, that the container 23 has the same diameter as the rotary disk 25, no loop such as the loop 22 would be produced in the center 26 where the finishing action would occur inadequately. As a whole, the workpieces would have an uneven finishing action.

SUMMARY OF THE INVENTION

The present invention addresses the particular problem raised by the prior art machine. As a solution to tile problem, the present invention proposes to arrange the permanent magnets in a random or irregular fashion, thereby allowing the magnetic fields to be varied in an irregular fashion rather than allowing them to be varied in the regular fashion.

One object of the present invention is to provide a magnetic barrel finishing machine that includes a rotary disk made of nonferromagnetic material on which permanent magnets are securely mounted, and a container to be placed above the rotary disk with a little gap therebetween and for containing workpieces to be finished and an abrasive medium containing ferromagnetic substances. The permanent magnets on the rotary disk are arranged randomly or irregularly in such a way that the plurality of permanent magnets produce magnetic lines of force acting in the circumferential direction as well as in the radial direction of the rotary disk.

Another object of the present invention is to provide a magnetic barrel finishing machine that includes a rotary disk made of nonretromagnetic material on which permanent magnets are securely mounted and a container to be placed above the rotary disk with a little gap therebetween for containing workpieces to be finished and and abrasive medium containing ferromagnetic substances. The permanent magnets on the rotary are arranged randomly or irregularly in such a way that the plurality of permanent magnets produces the magnetic lines of force acting in the circumferential direction as well as in the radial direction of the rotary disk and wherein the permanent magnets in each group are arranged in a diametrically symmetrical configuration.

A further object of the invention is to provide a magnetic barrel finishing machine wherein an outermost group of permanent magnets includes three permanent magnets each for providing N polarity and three permanent magnets each providing S polarity which are arranged concentrically at regular intervals and are located diametrically opposite each other, an intermediate group of permanent magnets includes two permanent magnets each for providing N polarity which are arranged concentrically and located diametrically opposite each other, and an innermost group of permanent magnets includes two permanent magnets each for providing S polarity which are arranged concentrically and located diametrically opposite each other.

As is clear from the above, the magnet arrangement may have a number of possible variations that may be implemented on different rotary disks. Those rotary disks may be used interchangeably, depending upon the specific finishing requirements. Each of the different rotary disks causes workpieces and the abrasive medium to flow in a different way, thus allowing workpieces to be finished according to the finishing requirements for the particular type and form of the workpieces, such as small segments, small rods, short pieces, and the like.

The ferromagnetic materials that may be contained in the abrasive medium may include ferromagnetic substances that provide the finishing action or other ferromagnetic pieces, or a mixture thereof. All or part of the abrasive medium may consist of ferromagnetic materials. The quantity of the ferromagnetic materials that may be contained in the abrasive medium should be sufficient to cause flows or motions of the abrasive medium.

The container in which the abrasive medium and works are placed is preferably made of any suitable nonferromagnetic material, and should preferably be closed at the open top in order to prevent the abrasive medium and the workpieces from going out of the container during the finishing operation. For example, the container may be made of any synthetic resin material, and may be equipped with a lid at the open top.

According to the present invention, a plurality of permanent magnets are arranged irregularly in such a way that they can provide magnetic lines of force in the circumferential direction as well as in the radial direction. Under the action of the rotating magnetic fields that are developed by those magnetic lines of force, the contents within the container, i.e., the mixture of abrasive medium and the workpieces, can flow in an irregular fashion, moving around within the container. Thus, the abrasive medium and workpieces can interact against each other in all possible ways. Workpieces can be finished evenly, regardless of whatever form or type the workpieces may have.

The following advantages and merits can be achieved by the present invention. As described, a given number of permanent magnets that provide one polarity, and the same number of permanent magnets that provide the opposite polarity are arranged randomly on the rotary disk. When the rotary disk is rotated in one direction at a constant speed, the permanent magnets produce alternating magnetic fields that cause the workpieces and the abrasive medium to flow in an irregular fashion into two different groups, one group of flows occurring in the circumferential direction and the other group of flows occurring in the radial direction. Advantageously, the workpieces surfaces can be finished evenly regardless of whatever complicated forms or shapes the workpieces may have. As there is no vacancy in the center on the rotary disk where no flow occurs, the workpieces can be finished even when they are located there.

BRIEF DESCRIPTION OF THE DRAWINGS

The above and other objects, advantages, and features of the present invention will become more apparent from the detailed description of the particular preferred embodiments of the present invention that follows, with reference to the accompanying drawings, in which.

DESCRIPTION OF THE PREFERRED EMBODIMENTS

Figure 1:
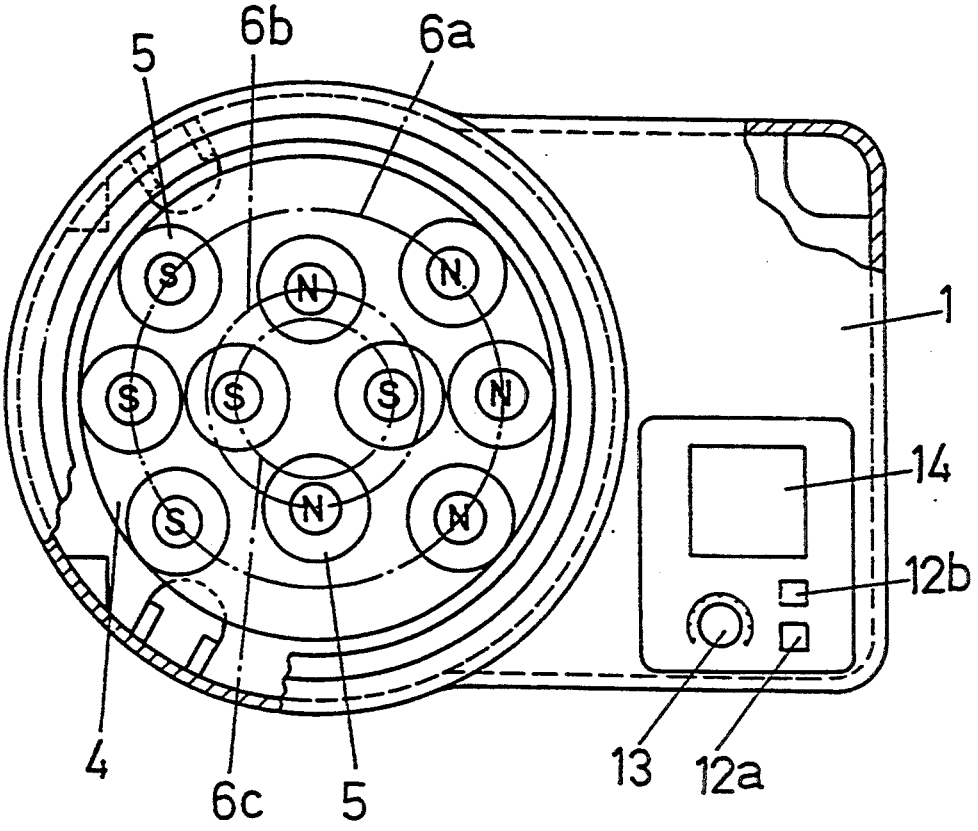
FIG. 1 is a plan view of an apparatus according to a particular preferred embodiment of the present invention, with some parts shown in cross section.

The particular preferred embodiment of the present invention is described below by referring to FIGS. 1 and 2. As particularly shown in FIG. 1, a housing 1 contains a vertically-mounted motor 2 with a drive shaft 3 to which a rotary disk 4 of any nonferromagnetic material is secured. The rotary disk 4 carries a plurality of individual ring-like permanent magnets 5 rigidly fixed thereon, with their respective north (N) or south (S) polarities on the upper side thereof. The individual magnets 5 are divided into two groups consisting of an equal number of magnets, one group providing one polarity, e.g. South, and the other group providing the opposite polarity, e.g. North. The individual magnets 5 in the two groups are arranged randomly or irregularly, leaving spaces between the adjacent magnets without contacting each other. When the rotary disk 4 is rotating, it would cause vibrations if those magnets were not placed in such a manner as to maintain the rotary disk 4 in equilibrium. For example, one way to avoid this is to arrange the magnets in a symmetrical configuration across the diameter of the rotary disk 4.

A round plate 7 is mounted on an inner peripheral shoulder 8 of the housing 1 that extends inwardly. The rotating magnetic field generated by the magnets 5 while the rotary disk 4 is rotating must be allowed to pass through the round plate 7 and go out of the housing 1 without being obstructed by the round plate 7. It is therefore important that the round plate 7 must be made of a completely nonferromagnetic material that will never have any effect on the magnetic field.

A cylindrical container 11 with a lid or covering 15 removably mounted thereon is placed on the round plate 7, and contains workpieces 9 such as small metal parts and an adequate amount of abrasive medium 10. The container 11 may be made of any suitable synthetic resin material.

Figure 2:
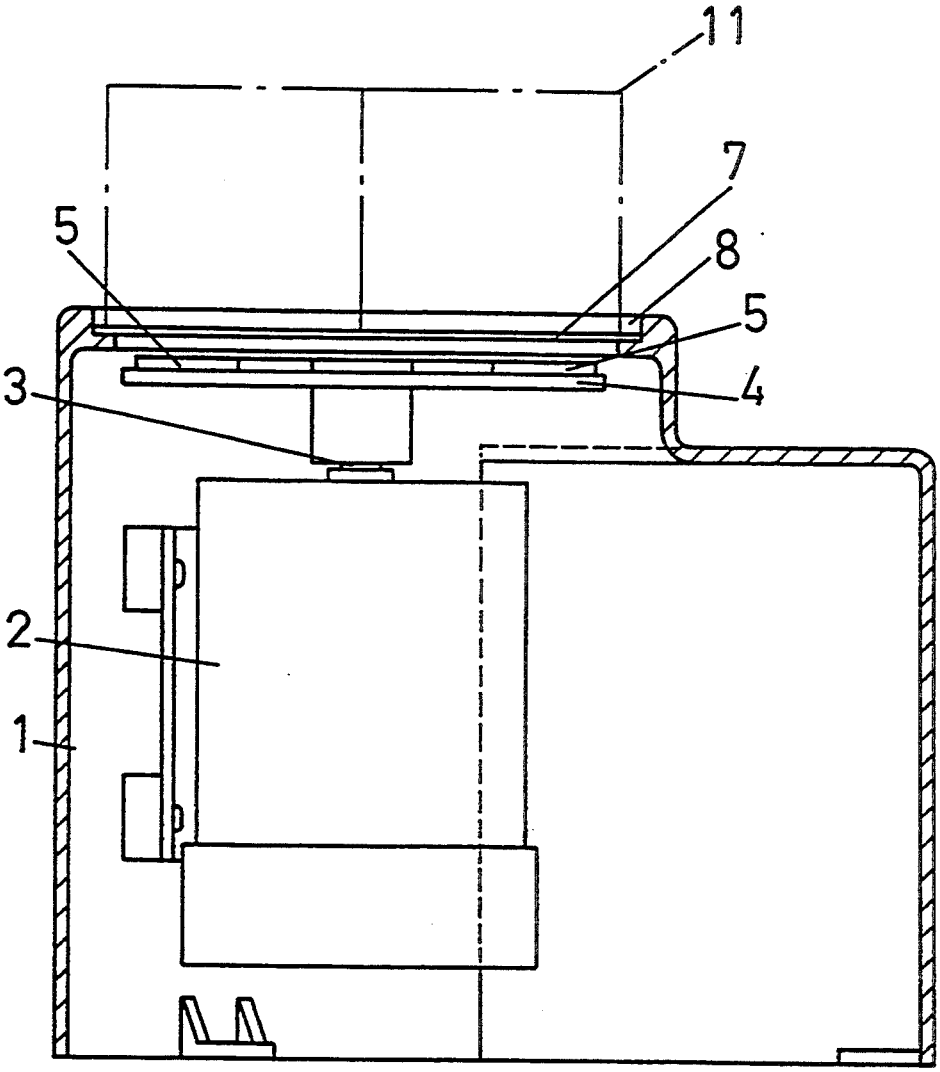
FIG. 2 is a front view of the apparatus shown in FIG. 1, with some parts shown in cross section.
Figure 3:
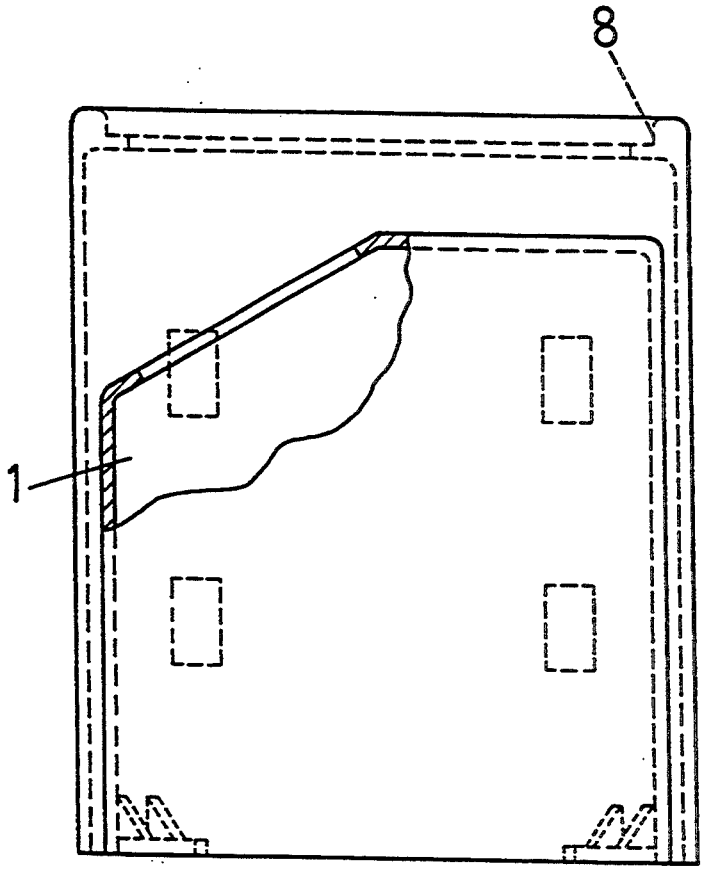
FIG. 3 is a side view of the apparatus shown in FIG. 1 with some parts shown in cross section.
Figure 4:
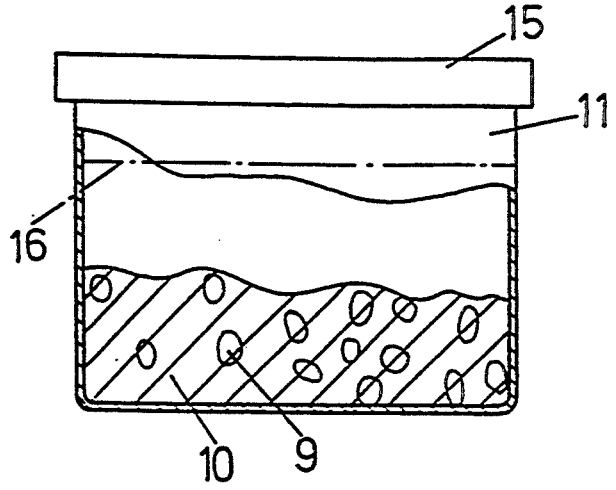
FIG. 4 is a segmentary sectional view illustrating a container that contains workpieces and an abrasive medium and is on an enlarged scale.

In FIG. 1, reference numerals **12*a* and 12*b* refer to ON/OFF switches, 13 refers to a speed control, 14 refers to a timer, and in FIG. 4, reference numeral 16** refers to the level of the polishing solution medium.

In operation, an abrasive medium 10 and workpieces 9 are placed into the container 11. The amount of the abrasive medium 10 is substantially equal to or less than half of the capacity of the container 11, and the quantity of workpieces 9 is substantially equal to or less than half of the amount of abrasive media 10. The abrasive media 10 may consist of ferromagnetic abrasive media or a mixture of ferromagnetic abrasive media and nonferromagnetic abrasive media. Then, the container 11 with the lid 15 thereon is placed on the round plate 7. When a motor (2) is started to cause the rotary disk 4 to rotate at 1000 to 4000 rpm, for example, the permanent magnets produce an alternating magnetic field which causes the medium 10 to flow in a random or irregular fashion. Accordingly, the workpieces can move around within the container 11, and can easily have uniformly finished surfaces regardless of whatever complicated forms or shapes they may have.

Figure 5:
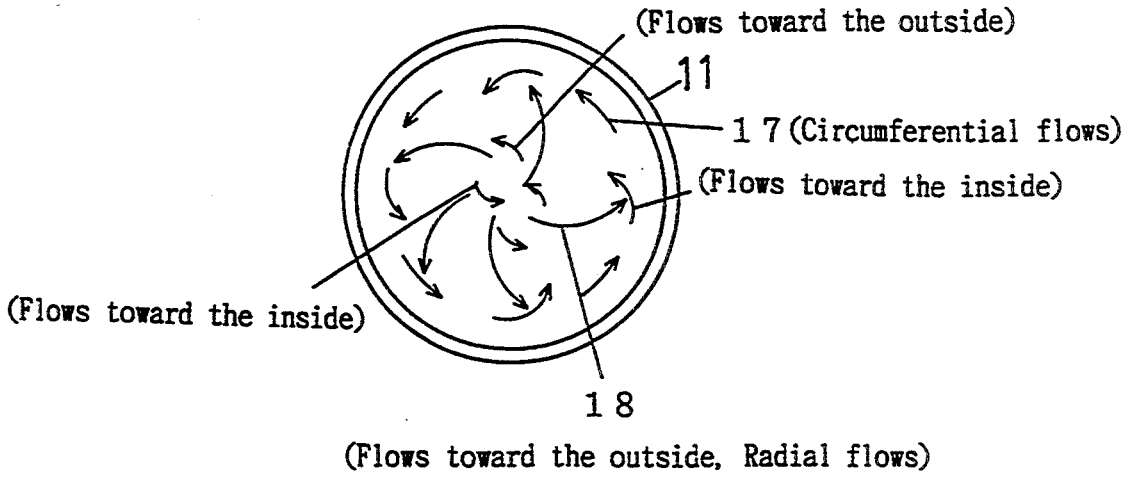
FIG. 5 is a schematic diagram illustrating the motions of the workpieces and the abrasive medium as seen in a plane.

FIG. 5 depicts the different motions or flows of the workpieces and abrasive media that are caused by the change in the magnetic field. As shown, those motions or flows include those that occur circumferentially and concentrically (as indicated by arrows 17), and those that occur radially (as indicated by arrows 18). More clearly, FIG. 6 depicts two different groups of loops, one group being produced circumferentially (as shown by 19) and the other group being produced inwardly or outwardly (as shown by 20).

Figure 6:
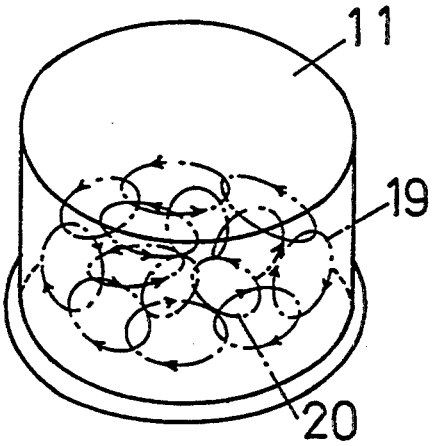
FIG. 6 is a schematic diagram illustrating the motions of workpieces and the abrasive medium shown from a perspective view.
Figure 7:
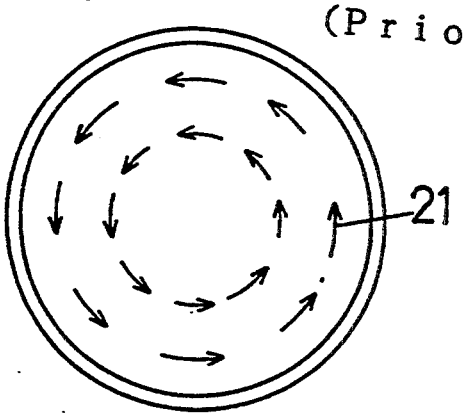
FIG. 7 (Prior Art)
FIG. 7 is a schematic diagram illustrating the motions of the workpieces and the abrasive medium as seen in on a plane according to a prior art magnetic finishing process.
Figure 8:
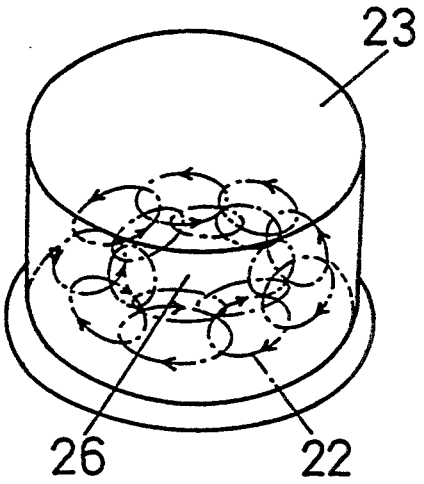
FIG. 8 (Prior Art)
FIG. 8 is a schematic diagram similar to FIG. 7, illustrating the motions of the workpieces and the abrasive medium from a perspective view.
Figure 9:
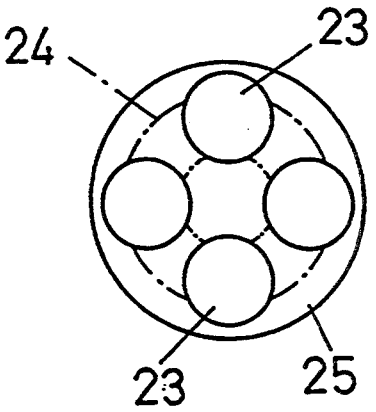
FIG. 9 (Prior Art)
FIG. 9 is a schematic diagram in plan showing containers placed within a magnetic finishing zone in the prior art.

As seen from FIGS. 5 and 6, there is no vacancy in the center on the rotary disk 4 where no motion or flow of the workpieces and abrasive medium occurs within the container. Thus, the container 11 may be placed anywhere on the round plate 7, or a single container that has substantially the same diameter as the round plate 7 may be used. In either case, the workpieces can be finished evenly. A container that has a diameter as large as that in the prior art may also be used. In this case, the diameter of the rotary disk 4 can be reduced, and the whole construction can become compact.

A part of the workpieces and the abrasive medium which exist near the inner-wall of the container 11 may change its place with another part of workpieces and the abrasive medium which exists near the center of the container 11 by the above described two groups of flows or motions of works and abrasive media during the finishing operation. This further improves the even surface finishing efficiency.

The motor may be reversed at any regular time intervals or periodically during the operation, thereby producing different flows or motions. That is, when the motor is reversed from one sense of rotation to the opposite sense of rotation, the flows that have occurred from the outside toward the inside or from the inside toward the outside will be switched from the inside toward the outside or from the outside toward the inside. By switching or swapping the flows in this way, the workpieces can be finished in different ways.

The result is that the workpieces can be finished evenly in all ways, and their details can thus also be finished.

Although the present invention has fully been described by referring to the particular preferred embodiment of the present invention, it should be understood that various changes and modifications may be made without departing from the spirit and scope of the invention as defined in the appended claims.

What is claimed is:

1. A magnetic barrel finishing machine, comprising:

a rotary disk made of a nonferromagnetic material;

a plurality of permanent magnets rigidly mounted on said rotary disk; and a container for containing workpieces to be finished and an abrasive medium comprising a ferromagnetic material, said container being located above said rotary disk such that a gap is between said container and said rotary disk;

wherein said plurality of permanent magnets are irregularly arranged on said rotary disk such that said plurality of permanent magnets provide magnetic lines of force acting in a circumferential direction of said rotary disk and in a radial direction of said rotary disk;

wherein said plurality of permanent magnets are arranged on said rotary disk so as to be in a diametrically symmetrical configuration; and wherein said plurality of permanent magnets comprises an outermost group of permanent magnets that comprises three permanent magnets each providing an N polarity and three permanent magnets providing an each S polarity arranged on said rotary disk along a circle concentric with said rotary disk, said three permanent magnets providing an N polarity being located diametrically opposite said three permanent magnets providing an S polarity, an intermediate group of magnets comprising two permanent magnets each providing an N polarity arranged on said rotary disk along a second circle concentric with said rotary disk and diametrically opposite to each other, and an innermost group of permanent magnets comprising two permanent magnets providing an S polarity and arranged on said rotary disk along a third circle concentric with said rotary disk and being arranged diametrically opposite to each other.

2. The magnetic barrel of claim 1, wherein said rotary disk is rotatably connected with a shaft of a motor.

3. The magnetic barrel of claim 2, wherein:

said motor is mounted in a housing comprising a round plate of a nonferromagnetic material on an upper surface of said housing;

said rotary disk is connected to said shaft of said motor such that said rotary disk is located immediately below said round plate; and said container is mounted on said round plate.

4. A magnetic barrel finishing machine, comprising:

a rotary disk made of a nonferromagnetic material;

a plurality of permanent magnets rigidly mounted on said rotary disk; and a container for containing workpieces to be finished and an abrasive medium comprising a ferromagnetic material, said container being located above said rotary disk such that a gap is between said container and said rotary disk;

wherein said plurality of permanent magnets are arranged on said rotary disk such that said plurality of permanent magnets provide magnetic lines of force acting in a circumferential direction of said rotary disk and in a radial direction of said rotary disk;

wherein said plurality of permanent magnets are arranged on said rotary disk so as to be in a diametrically symmetrical configuration; and wherein said plurality of permanent magnets comprises an outermost group of permanent magnets that comprises three permanent magnets each providing an N polarity and three permanent magnets providing an each S polarity arranged on said rotary disk along a circle concentric with said rotary disk, said three permanent magnets providing an N polarity being located diametrically opposite said three permanent magnets providing an S polarity, an intermediate group of magnets comprising two permanent magnets each providing an N polarity arranged on said rotary disk along a second circle concentric with said rotary disk and diametrically opposite to each other, and an innermost group of permanent magnets comprising two permanent magnets providing an S polarity and arranged on said rotary disk along a third circle concentric with said rotary disk and being arranged diametrically opposite to each other.

5. The magnetic barrel of claim 4, wherein said rotary disk is rotatably connected with a shaft of a motor.

6. The magnetic barrel of claim 5, wherein:

said motor is mounted in a housing comprising a round plate of a nonferromagnetic material on an upper surface of said housing;

said rotary disk is connected to said shaft of said motor such that said rotary disk is located immediately below said round plate; and said container is mounted on said round plate.

* * * * *